US007014390B1

(12) United States Patent
Morris

(10) Patent No.: US 7,014,390 B1
(45) Date of Patent: Mar. 21, 2006

(54) DRAINAGE MEMBER WITH EXPANSION ZONES

(75) Inventor: R. Scott Morris, Matthews, NC (US)

(73) Assignee: American Wick Drain Corporation, Monroe, NC (US)

( * ) Notice: Subject to any disclaimer, the term of this patent is extended or adjusted under 35 U.S.C. 154(b) by 0 days.

(21) Appl. No.: 10/984,580

(22) Filed: Nov. 9, 2004

(51) Int. Cl.
*E02B 11/00* (2006.01)

(52) U.S. Cl. ..... 405/50; 405/43; 405/36; 52/169.5

(58) Field of Classification Search ..... 405/50, 405/45, 43, 36; 52/169.5
See application file for complete search history.

(56) References Cited

U.S. PATENT DOCUMENTS

| | | | | |
|---|---|---|---|---|
| 3,888,087 | A * | 6/1975 | Bergsland | 52/169.5 |
| 4,815,892 | A * | 3/1989 | Martin | 405/45 |
| 4,840,515 | A * | 6/1989 | Freese | 405/45 |
| 4,943,185 | A * | 7/1990 | McGuckin et al. | 405/45 |
| 5,044,821 | A * | 9/1991 | Johnsen | 405/50 |
| 5,601,886 | A | 2/1997 | Ishikawa et al. | 428/17 |
| 5,688,073 | A * | 11/1997 | Brodeur et al. | 405/45 |
| 5,775,839 | A * | 7/1998 | Mazzer | 405/50 |
| 5,779,393 | A | 7/1998 | Gunter | 405/121 |
| 5,976,645 | A | 11/1999 | Daluise et al. | 428/17 |
| 6,221,445 | B1 | 4/2001 | Jones | 428/17 |
| 6,241,421 | B1 * | 6/2001 | Harvie et al. | 405/45 |
| 6,648,550 | B1 * | 11/2003 | Parker | 405/50 |
| 6,672,016 | B1 * | 1/2004 | Janesky | 52/169.5 |
| 6,691,472 | B1 * | 2/2004 | Hubert | 52/169.5 |

OTHER PUBLICATIONS

Advertisement from ProGreen Sports Surfaces, LLC entitled "Total Turf Technology, Typical Prodrain™ Edge Detail and Base Cross-Section", ©2002.
Advertisement from ProGreen Sports Surfaces, LLC entitled "Total Turf Technology, Typical Cross-Section", ©2003.
Brochure from Pro Green Sport Surfaces, LLC entitled "Total Turf Technology Since 1987, Replicated Grass ProGreen Since 1987," ©2003, 8 pages.
Brochure from Advanced Polymer Technology, POLIGRAS®, Sports Technology International, 6 pages.
Brochure from FieldTurf Inc., FIELDTURF, The Company That Revolutionzed An Industry , 8 pages.
Brochure from Field Turf Inc., FIELDTURF, Looks like grass . . . , Feels like grass . . . Plays like grass.™, 2 pages.
Brochure from Akzo Nobel Geosynthetics Company, ENKATURF™, Turf Maintenance System, 4 pages.

* cited by examiner

*Primary Examiner*—Frederick L. Lagman
(74) *Attorney, Agent, or Firm*—Kennedy Covington Lobdell & Hickman, LLP

(57) ABSTRACT

A drainage member for use in promoting the drainage of water away from a substrate positioned adjacent the drainage member which includes an elongated, longitudinally extending base formed of a flexible material and having a plurality of outwardly extending projections. The projections are spaced from one another to form drainage channels between the projections. The elongated base has a plurality of expansion zones formed of the flexible material and extending generally transversely of the longitudinal extent thereof, the expansion zones comprising a deformation of the flexible material that absorbs longitudinal expansion of such material when it is exposed to heat without any significant increase in the longitudinal length of the drainage member.

27 Claims, 5 Drawing Sheets

DRAINAGE MEMBER WITH EXPANSION ZONES

BACKGROUND OF THE INVENTION

The present invention relates generally to systems for draining water away from a generally flat substrate, and more particularly to a drainage member that is designed to be located beneath an upper layer of material, such as artificial turf, synthetic turf or the like, for draining away water that seeps through such upper layer.

It has been known for some time that natural grass can be replaced with artificial or synthetic turf in many environments. In general, artificial turf requires considerably less maintenance than natural grass or sod, and it can often be used in locations where natural grass cannot be grown. Artificial turf systems can take various forms, and one typical system is disclosed in U.S. Pat. No. 5,601,886 in which the artificial turf is fabricated in a tufting machine so that artificial turf filaments penetrate backing material.

While there are many applications for artificial turf, perhaps the most common are on athletic fields such as indoor and outdoor soccer fields or football fields, and on golf greens. Typical applications of this type are disclosed, for example, in U.S. Pat. Nos. 5,779,393; 5,976,645; and 6,221,445. When the artificial turf system is used in an outdoor environment where it is subjected to rain and other sources of water, the system must have some provision for draining water that would otherwise accumulate on top of, underneath, and within the filaments of the artificial turf.

One type of drainage system that is frequently used with artificial turf is a thick layer of sand or other small loose particles through which water can drain, such as the system disclosed in the aforesaid U.S. Pat. No. 6,221,445. While these drainage systems and others like them are adequate for properly draining the water away from the artificial turf, they are costly, both from the standpoint of the costs of the materials themselves as well as the significant labor costs involved in properly installing the drainage system.

There has been some experimentation in trying to substitute less expensive known drainage systems that are formed from a plastic material, such as polystyrene, polyethylene or the like, and that include projections with spaces therebetween to create drainage passageways for draining away excess water. However, it was found that these drains could undergo significant expansion when they are exposed to typical heat conditions that are often encountered by artificial turf systems. When these drainage systems were employed in the long lengths normally required for large areas of artificial turf, such as football or soccer fields, the expansion problem was exacerbated to the point that it created wrinkles and other malformations of the artificial turf which are difficult and expensive to correct.

In accordance with the present invention, a drainage member is provided that is considerably less expensive than known drainage systems, and avoids the problem of undue expansion of the drainage member.

SUMMARY OF THE INVENTION

The present invention includes a drainage member for use in promoting the drainage of water away from a substrate positioned adjacent to the drainage member. The drainage member includes an elongated, longitudinally extending base formed of a flexible material and having a plurality of outwardly extending projections, with the projections being spaced from one another to form drainage channels between the projections. The elongated base has a plurality of expansion zones formed of the flexible material and extending generally transversely of the longitudinal extent thereof, the expansion zones comprising a deformation of the flexible material that absorbs longitudinal expansion of such material when it is exposed to heat without any significant increase in the longitudinal length of the drainage member.

In one of the preferred embodiments of the present invention, the deformation of the flexible material may be caused by forming one or more u-shaped grooves extending generally transversely to the longitudinal extent of the base portion. In another preferred embodiment, the deformation may be caused by a plurality of holes or slots penetrating the base portion and extending along a line that is generally transverse to the longitudinal extent of the base portion. In yet another preferred embodiment, the deformation is caused by reducing the thickness of the flexible material forming the base portion along a width that is generally transverse to the longitudinal extent of the base portion.

Preferably the projections of drainage member are generally cone shaped and extend perpendicularly away from the base portion, and the extending ends of the projections are flat for supporting a substrate thereon.

The present invention also includes a method of forming a drainage member comprising the steps of providing a longitudinally extending flat base portion formed of flexible material; deforming the base portion to create a plurality of projections extending away from the flat base portion in spaced relation to one another to form drainage channels between the projections; and deforming the base portion to form expansion zones extending generally transversely of the longitudinal extent of the base portion so that the expansion zones will absorb longitudinal expansion of such material when it is exposed to heat without any significant increase in the longitudinal length of the drainage member.

In the preferred embodiment of the method of the present invention, the step of deforming the base portion to form expansion zones may include deforming the base portion into one or more v-shaped grooves extending transversely to the longitudinal extent of the base portion; or creating a plurality of holes or slots penetrating the base portion and extending along a line that is generally transverse to the longitudinal extent of the base portion; or reducing the thickness of the base portion along a width that is generally transverse to the longitudinal extent of the base portion.

DESCRIPTION OF THE PREFERRED EMBODIMENTS

Figure 1:
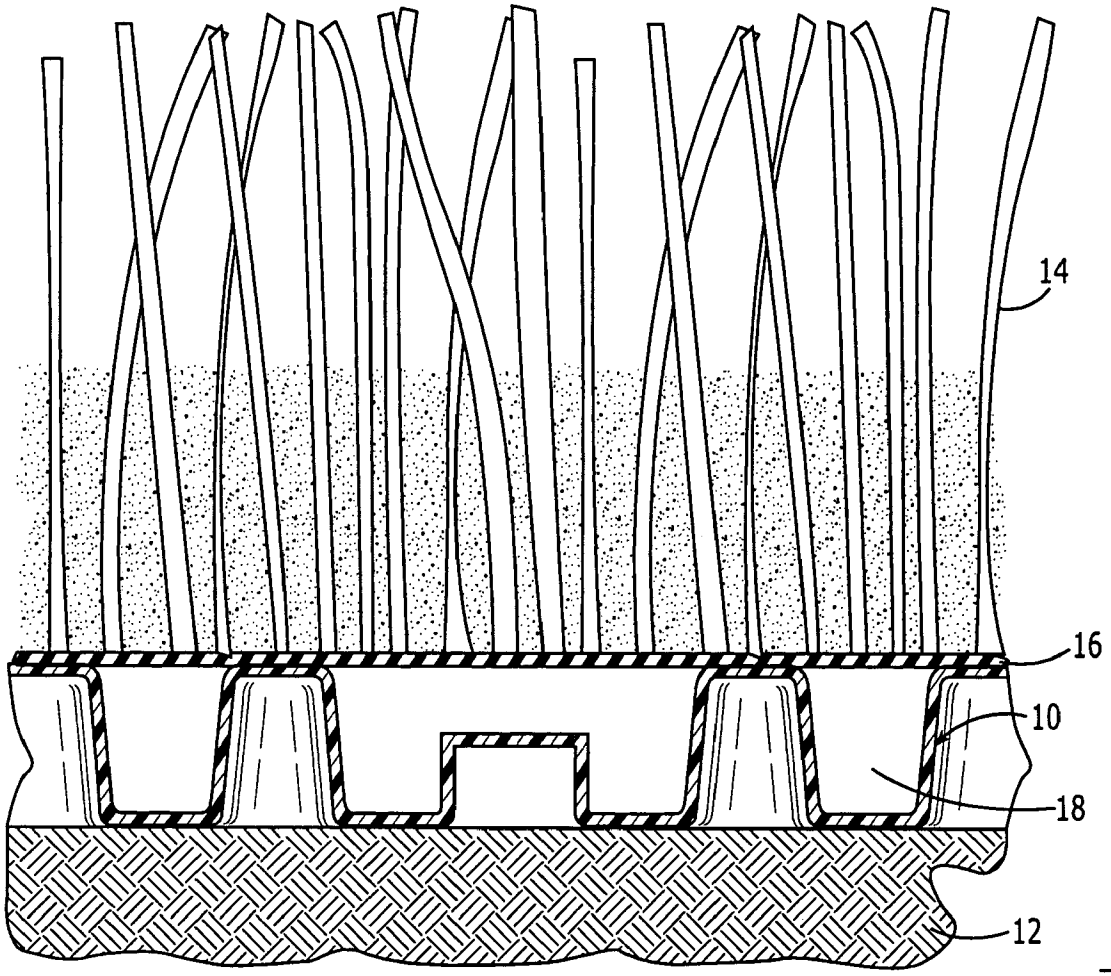
FIG. 1 is a diagrammatic view illustrating one typical artificial turf system in which the drainage member of the present invention is utilized.

Looking now in greater detail at the accompanying drawings, FIG. 1 illustrates a typical environment in which a drainage member 10 according to the present invention is utilized. More specifically, FIG. 1 illustrates an artificial turf system which includes a foundation 12 which may be composed of virtually any type of firm material, and the drainage member 10 is supported on top of the foundation 12. Artificial grass or turf 14 is supported on top of the drainage member 10 so that the water collecting on or within the artificial turf 14 will penetrate the bottom layer 16 of the artificial turf and flow into the open areas or drainage channels 18 of the drainage member 10, as will be described in greater detail below. The water which collects in the drainage member 10 is channeled so that it will flow away from the artificial turf through a conventional water discharge conduit or the like (not shown) in a manner that is well known in the art. It is expressly understood that the environment for the present invention which is illustrated in FIG. 1 is just one of a wide variety of applications in which the drainage member 10 can be utilized. For example, and not by way of limitation, the drainage member 10 could be used under paving stones, or loose bricks and the like.

Figure 2:
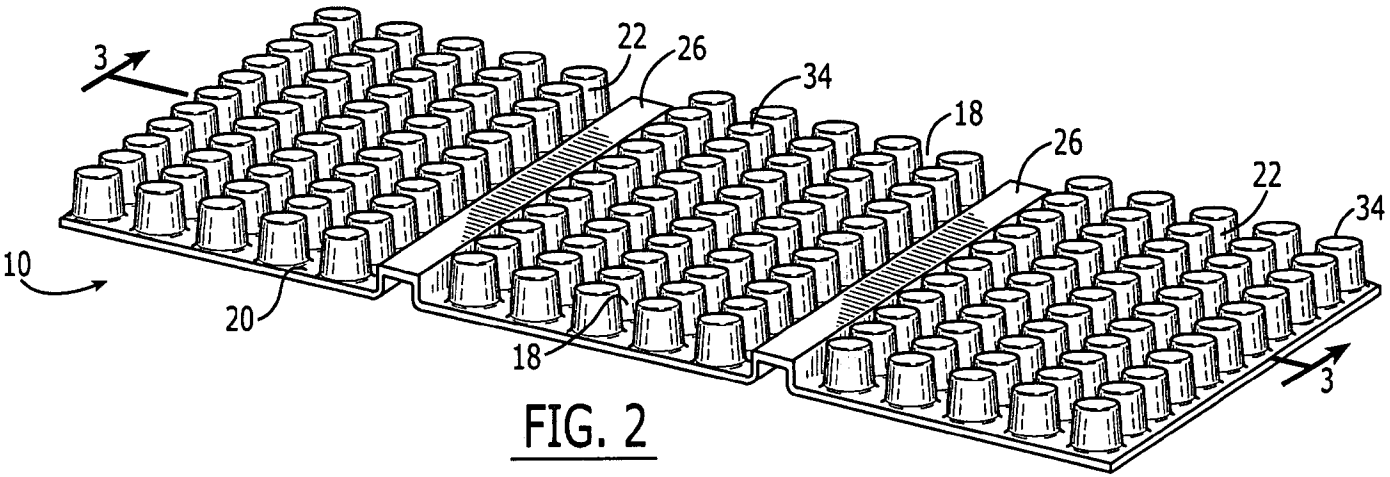
FIG. 2 is a perspective view of one embodiment of the drainage member of the present invention.
Figure 3:
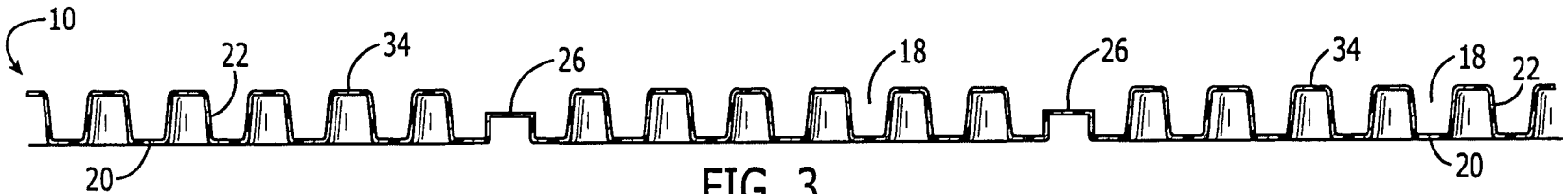
FIG. 3 is an end view of the drainage member illustrated in FIG. 2.

FIGS. 2 and 3 illustrate one preferred embodiment of the present invention. In this embodiment, the drainage member 10 includes a general horizontally extending base portion 20 that is formed of a flexible material which is preferably polystyrene, but which may be formed of any equivalent flexible material. The base portion 20 is deformed to create a large number of projections 22 that are spaced from one another to form the drainage channels 18 between the projections 22, thereby forming a drainage zone.

The base 20 is also deformed into one or more grooves 26 that generally have an inverted u-shaped configuration in cross-section as best illustrated in FIG. 3, and that extend generally transversely to the longitudinal extent of the base portion 20. These grooves 26 are configured and spaced from one another so that when the drainage member 10 is exposed to heat that would normally cause significant expansion of the drainage member in the direction of its longitudinal extent, the grooves 26 form expansion zones that permit the base portion 20 of the elongated drainage member 10 to expand and retract in the direction of the longitudinal extent of the drainage member 10. Therefore, the expansion zones are designed to absorb the longitudinal expansion of the drainage member 10 so that when the drainage member 10 is exposed to a predetermined amount of heat that would normally result in significant expansion of the drainage member in its longitudinal direction, there will be no significant increase in the longitudinal length of the drainage member 10 as a whole. It will be understood that the deformation of the grooves 26 may have configurations other than the inverted u-shaped configuration illustrated in FIGS. 2 and 3, provided that the configuration of the grooves 26 is such that they will permit the base portion of the elongated drainage member 10 to expand and retract as described above.

Figure 4:
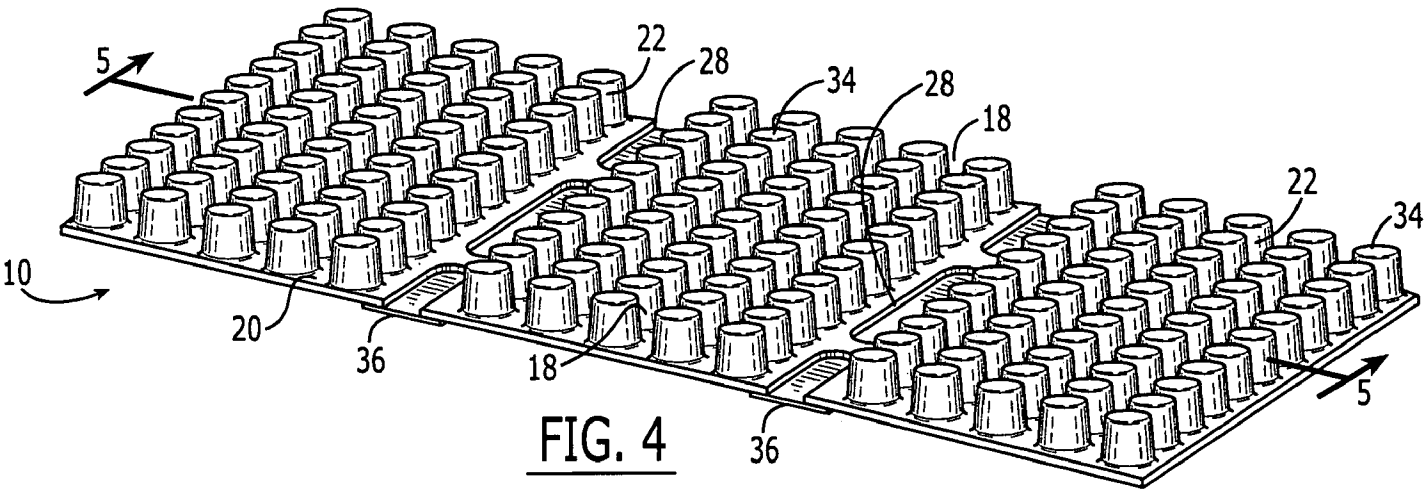
FIG. 4 is a perspective view of another embodiment of the drainage member of the present invention.
Figure 5:
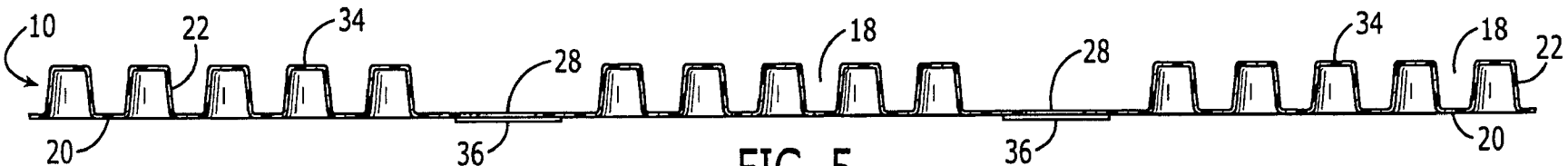
FIG. 5 is a section view of the drainage member illustrated in FIG. 4 taken along line 5—5.

Another embodiment of the drainage member 10 of the present invention is illustrated in FIGS. 4 and 5, where like reference numerals are used to identify like components. In this embodiment, the base portion 20 is deformed to create expansion zones comprised of a plurality of slots 28 that penetrate the base portion 20 and extend along a line that is generally transverse to the longitudinal extent of the base portion 20. The size, shape and number of the slots 20 are selected to permit the base portion 20 to expand and retract when exposed to heat as described above, without any significant increase in the longitudinal extent of the drainage member 10. If it is desired in a particular application of this embodiment of the present invention to prevent water from penetrating the open slots 28, a thin strip of sealing material 36 may be secured to drainage member 10 so that it extends along the entire expansion zone formed by the slots 28 to prevent any water from passing therethrough. The sealing strip can be located below the slots 28 as illustrated in FIGS. 4 and 5, or, if desired, it could be located on top of the slots 28 (not shown). The thin sealing strip can be made of polystyrene or any other equivalent material that would prevent the penetration of water through the slots 28 without affecting the ability of the slots 28 to carry out their function of absorbing longitudinal expansion of the drainage member 10 as described above.

Figure 6:
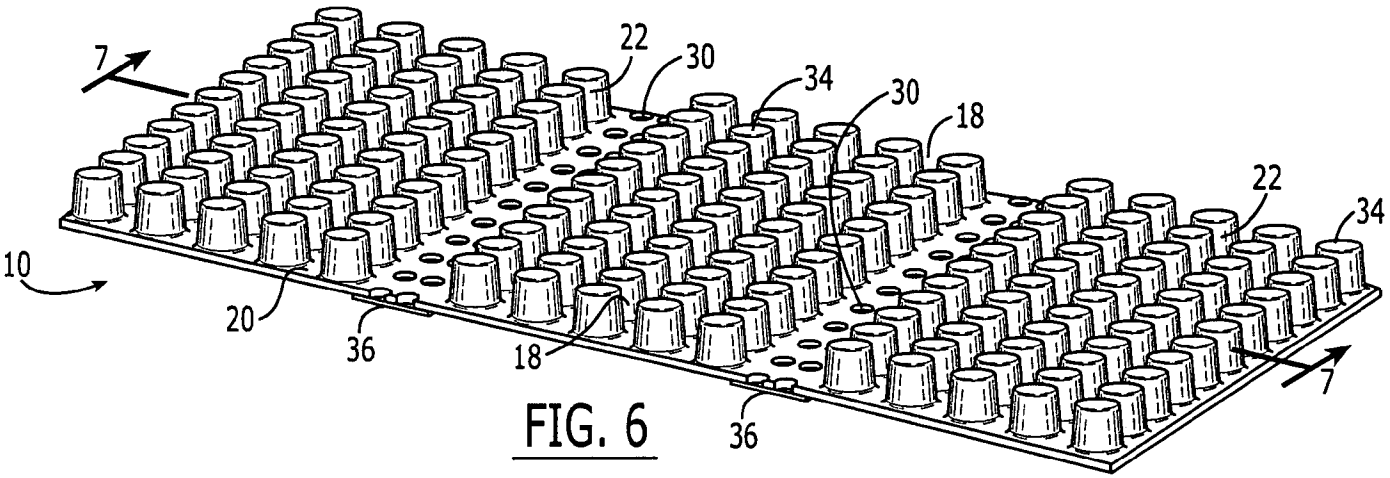
FIG. 6 is a perspective view of yet another embodiment of the drainage member of the present invention.
Figure 7:
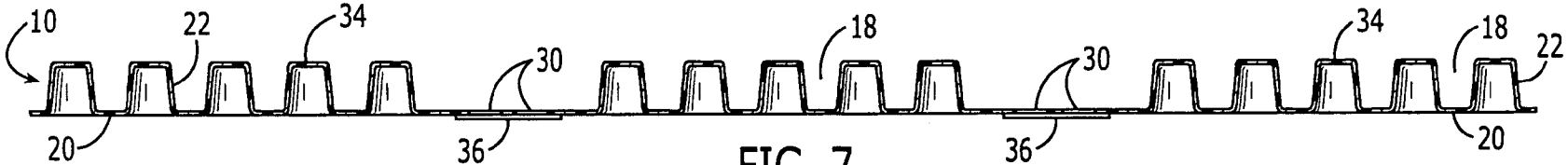
FIG. 7 is a section view of the drainage member illustrated in FIG. 6 taken along line 7—7.

Another embodiment of the present invention is illustrated in FIGS. 6 and 7, which again use the same reference numerals for the same elements. In this embodiment of the present invention the expansion zones consist of a plurality of holes 30 which penetrate the base 20 and extend along a line that is generally transverse to the longitudinal extent of the drainage member 10. As in the embodiment described in connection with FIGS. 4 and 5, the size, shape and number of the holes 30 are selected to cause the holes 30 to absorb the longitudinal expansion of the drainage member material when it is exposed to heat without any significant increase in the longitudinal extent of the drainage member 10. If desired, a sealing strip 36 like that described in connection with the embodiment illustrated in FIGS. 4 and 5 could be secured to the drainage member 10 to cover the holes 30 and prevent the flow of water therethrough as described above.

Figure 8:
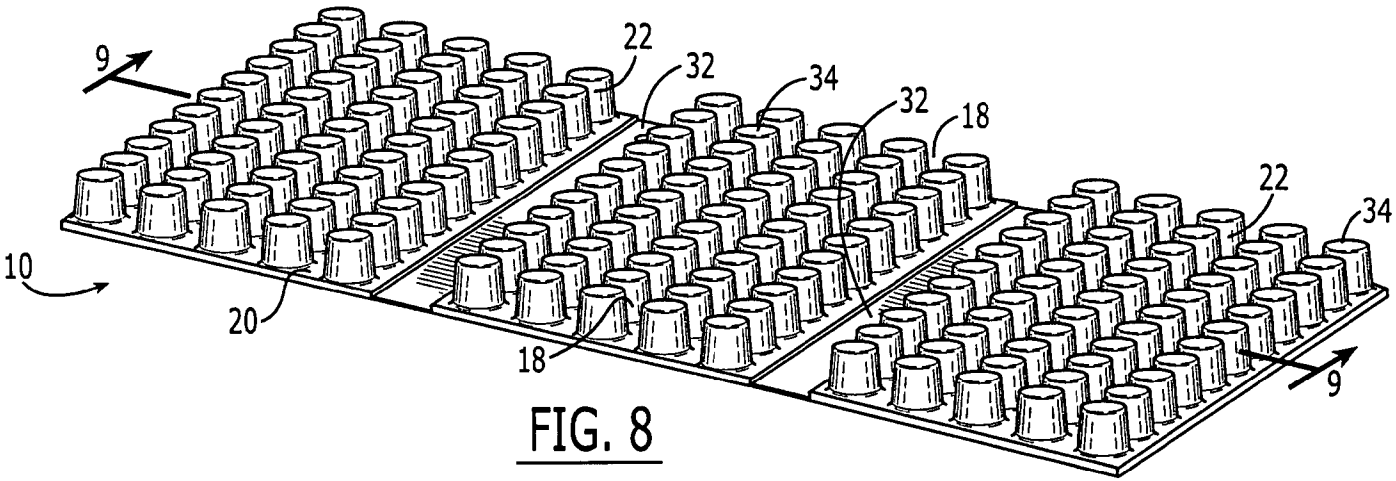
FIG. 8 is a perspective view of another embodiment of the drainage member of the present invention.
Figure 9:
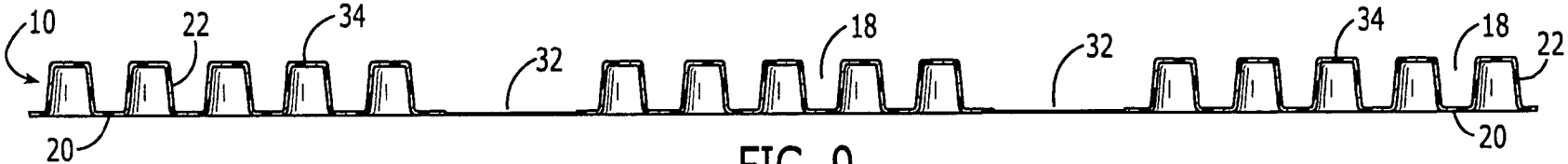
FIG. 9 is a section view of the drainage member illustrated in FIG. 8 taken along line 9—9.

Finally, yet another embodiment of the present invention is illustrated in FIGS. 8 and 9 where like elements are indicated by like reference numerals. In this embodiment, the expansion zones are created by deforming the base portion 20 so that it has a reduced thickness along a predetermined width that extends generally transverse to the longitudinal extent of the base portion 20, this reduced thickness portion being indicated by the reference numeral 32 in FIGS. 8 and 9.

Accordingly, in all of the embodiments of the present invention which are described above, the flexible material from which the drainage member 10 is deformed in some way to create the expansion zones that are specifically designed to absorb expansion of the drainage member 10 when it is exposed to a predetermined amount of heat that would otherwise cause significant and undesirable expansion of the drainage member 10 in its longitudinal direction. The drainage member 10 can be easily manufactured by starting with a desired flexible material, such as polystyrene or any equivalent flexible material, that has a desired thickness and flexibility, and then deforming this material to create the projections 22 and the expansion zones described above in connection with each of the several embodiments of the present invention. Moreover, in accordance with one of the features of the present invention, the drainage member 10 can be formed in very long lengths sufficient for use in football fields, soccer fields, and the like. For example, if the drainage member 10 is used in connection with a football field, which has a playing field that is fifty yards wide, it will typically be made into lengths that extend from one side of the artificial turf to the approximate center of the playing field, a length of approximately thirty yards in most cases. Two such lengths the drainage member 10 would be laid end-to-end to thereby cover the entire width of the artificial turf 14. These extending lengths of the drainage member 10 will usually be produced with predetermined widths, and they can easily be installed on top of a foundation 12 (see FIG. 1.) with a minimal of labor and with a small cost of material by installing a number of lengths on top of the foundation 12 to extend longitudinally across the field in side-by-side relationship to cover the entire football field or other area. Importantly, even though these drainage members 10 necessarily must be formed in very long longitudinal lengths, the expansion zones formed in the drainage members in accordance with the several embodiments of the present invention will act to absorb the longitudinal expansion of the materials formed in the drainage member 10 that would otherwise occur without the expansion zones and that could cause undesirable wrinkling or other malfunctions of the supported artificial turf 14, as described above.

It will be apparent to those skilled in the art that thickness of the material forming the drainage member 10, the type of material from which it is formed, the dimensions of the various parts of the drainage member 10 and the expansion zones as described above will vary depending on many parameters of the particular application of the drainage member 10. In one typical drainage member 10 for a football field, it is preferably formed of polystyrene and the expansion zones preferably has a width of about one inch, and the expansion zones are spaced from one another about four feet in the longitudinally extending direction of the drainage member 10.

Accordingly, in all of the embodiments of the present invention which are described above, the flexible material from which the drainage member 10 is made is deformed in some way to create the expansion zones that are specifically designed to absorb expansion of the drainage member 10 when it is exposed to a predetermined amount of heat that would otherwise cause significant and undesirable expansion of the drainage member 10 in its longitudinal direction. As is clear from FIGS. 2–8, when the drainage member material is deformed to create the expansion zones, the expansion zones are spaced apart from one another some predetermined distance in the longitudinal direction. Such distance is substantially greater than the longitudinal extent of a drainage zone. The drainage member 10 can be easily manufactured by starting with a desired flexible material, such as polystyrene or any equivalent flexible material, that has a desired thickness and flexibility, and then deforming this material to create the drainage zones, including projections 22 and channels, and the expansion zones described above in connection with each of the several embodiments of the present invention. Moreover, in accordance with one of the features of the present invention, the drainage member 10 can be formed in very long lengths sufficient for use in football fields, soccer fields, and the like. For example, if the drainage member 10 is used in connection with a football field, which has a playing field that is fifty yards wide, it will typically be made into lengths that extend from one side of the artificial turf to the approximate center of the playing field, a length of approximately thirty yards in most cases. Two such lengths of the drainage member 10 would be laid end-to-end to thereby cover the entire width of the artificial turf 14. These extending lengths of the drainage member 10 will usually be produced with predetermined widths, and they can easily be installed on top of a foundation 12 (see FIG. 1.) with a minimum of labor and with a small cost of material by installing a number of lengths on top of the foundation 12 to extend longitudinally across the field in side-by-side relationship to cover the entire football field or other area. Importantly, even though these drainage members 10 necessarily must be formed in very long longitudinal lengths, the expansion zones formed in the drainage members in accordance with the several embodiments of the present invention will act to absorb the longitudinal expansion of the materials formed in the drainage member 10 that would otherwise occur without the expansion zones and that could cause undesirable wrinkling or other malfunctions of the supported artificial turf 14, as described above.

It will be apparent to those skilled in the art that thickness of the material forming the drainage member 10, the type of material from which it is formed, the dimensions of the various parts of the drainage member 10 and the expansion zones as described above will vary depending on many parameters of the particular application of the drainage member 10. In one typical drainage member 10 for a football field, it is preferably formed of polystyrene and the expansion zones preferably have a width of about one inch, and the expansion zones are spaced from one another about four feet in the longitudinally extending direction of the drainage member 10, thus the space between expansion zones is clearly substantially greater than the longitudinal extent of each drainage zone.

Finally, while it is known to form conventional drainage members with projections like the projections 22 illustrated in the drawings, they are intended to have a water pervious fabric extending across the tops of the projections to permit water to flow into the drainage member through the fabric material. However, the projections 22 serve several unique functions in the drainage member 10 of the present invention. They can be made rigid enough to support artificial turf 14 and the like on top of the projections 22 as illustrated in FIG. 1, and at the same time they can be made with sufficient resiliency to absorb some of the shock loads imposed on the artificial turf 14 during use, such as the shock load resulting from a football player falling on the artificial turf 14. In the former regard, it should be noted that the top surfaces 34 of the projection 22 are flat to assist in supporting the artificial turf 14 or the like on. The shock absorbing advantage offered by the drainage member 10 of the present invention provides a substantial improvement over the known prior art arrangements discussed above in which a thick layer of sand or small loose particles is placed directly below the artificial turf and offers virtually no ability to absorb shock loads.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A drainage member for use in promoting the drainage of water away from a substrate positioned adjacent to said drainage member, said drainage member including an elongated, longitudinally extending base formed of a flexible material and having a plurality of longitudinally extending drainage zones consisting of a plurality of outwardly extending projections, said projections being spaced from one another to form drainage channels between said projections, and said elongated base having a plurality of expansion zones formed of said flexible material and extending generally transversely of the longitudinal extent thereof, said expansion zones comprising a deformation of said flexible material that absorbs longitudinal expansion of such material when it is exposed to heat without any significant increase in the longitudinal length of the drainage member and being spaced a predetermined distance from one another in the longitudinal direction, said distance being substantially greater than the longitudinal extent of said drainage zones.

2. A drainage member as defined in claim 1, wherein said expansion zones are deformed into one or more grooves extending generally transversely to said longitudinal extent of said base portion.

3. A drainage member as defined in claim 2, wherein said grooves have an inverted u-shaped configuration.

4. A drainage member as defined in claim 1, wherein said expansion zones are deformed by a plurality of holes penetrating said base portion and extending along a line that is generally transverse to said longitudinal of said base portion.

5. A drainage member as defined in claim 4, wherein a sealing strip is secured to said drainage member to cover said plurality of holes and prevent water from passing therethrough.

6. A drainage member as defined in claim 1, wherein said expansion zones are deformed by a plurality of slots penetrating said base portion and extending along a line that is generally transverse to said longitudinal extent of said base portion.

7. A drainage member as defined in claim 6, wherein a sealing strip is secured to said drainage member to cover said plurality of slots and prevent water from passing therethrough.

8. A drainage member as defined in claim 1, wherein said expansion zones are deformed by reducing the thickness of the flexible material forming said base portion along a width that is generally transverse to said longitudinal extent of said base portion.

9. A drainage member as defined in claim 1, wherein said projections are generally cone shaped and extend perpendicularly away from said base portion.

10. A drainage member as defined in claim 9, wherein the extending ends of said projections are flat for supporting a substrate thereon.

11. A drainage member as defined in claim 1, wherein said deformation of said flexible material in said expansion zone weakens the structural integrity of said flexible material to permit said absorption of the expansion of said base.

12. A drainage member for use in conjunction with synthetic turf and the like, said drainage member including an elongated, longitudinally extending base formed of a thin, flexible plastic material, said base having drainage zones each comprising a plurality of cone-shaped projections protruding away from said elongated base and spaced from one another to form drainage channels between said projections, said cone-shaped projections have flat end portions for supporting said synthetic turf, and said elongated base having a plurality of expansion zones formed of the same flexible material as the rest of said base and extending generally transversely to the longitudinal extent of said base, said expansion zones comprising deformations of said flexible material that weaken the structural integrity of said flexible material in said expansion zones to accommodate and absorb longitudinal expansion and retraction of said drainage zones between said expansion zones and being spaced a predetermined distance from one another in the longitudinal direction, said distance being substantially greater than the longitudinal extent of said drainage zones.

13. A drainage member as defined in claim 12, wherein said expansion zones are deformed into one or more grooves extending generally transversely to said longitudinal extent of said base portion.

14. A drainage member as defined in claim 13, wherein said grooves have an inverted u-shaped configuration.

15. A drainage member as defined in claim 12, wherein said expansion zones are deformed by a plurality of holes penetrating said base portion and extending along a line that is generally transverse to said longitudinal of said base portion.

16. A drainage member as defined in claim 15, wherein a sealing strip is secured to said drainage member to cover said plurality of holes and prevent water from passing therethrough.

17. A drainage member as defined in claim 12, wherein said expansion zones are deformed by a plurality of slots penetrating said base portion and extending along a line that is generally transverse to said longitudinal extent of said base portion.

18. A drainage member as defined in claim 17, wherein a sealing strip is secured to said drainage member to cover said plurality of slots and prevent water from passing therethrough.

19. A drainage member as defined in claim 12, wherein said expansion zones are deformed by reducing the thickness of the flexible material forming said base portion along a width that is generally transverse to said longitudinal extent of said base portion.

20. A method of forming a drainage member comprising the steps of:

a) providing a longitudinally extending flat base portion formed of flexible material;

b) deforming said base portion to create a plurality of longitudinally extending drainage zones consisting of a plurality of projections extending away from said flat base portion in spaced relation to one another to form drainage channels between said projections; and c) deforming said base portion to form expansion zones extending generally transversely of the longitudinal extent of said base portion so that said expansion zones will absorb longitudinal expansion of such material when it is exposed to heat without any significant increase in the longitudinal length of the drainage member said expansion zones being spaced a predetermined distance from one another in the longitudinal direction, said distance being substantially greater than the longitudinal extent of said drainage zones.

21. A method of forming a drainage member as defined in claim 20 wherein said step of deforming said base portion to form expansion zones includes deforming said base portion into one or more grooves extending transversely to said longitudinal extent of said base portion.

22. A method of forming a drainage member as defined in claim 21, wherein said grooves are formed with an inverted unshaped configuration.

23. A method of forming a drainage member as defined in claim 20, wherein said step of deforming said base portion to form expansion zones includes creating a plurality of holes penetrating said base portion and extending along a line that is generally transverse to said longitudinal of said base portion.

24. A method of forming a drainage member as defined in claim 23, wherein said method includes the step of securing a sealing strip to said drainage member to cover said plurality of holes and prevent water from flowing therethrough.

25. A method of forming a drainage member as defined in claim 20, wherein said step of deforming said base portion to form expansion zones includes creating a plurality of slots penetrating said base portion and extending along a line that is generally transverse to said longitudinal extent of said base portion.

26. A method of forming a drainage member as defined in claim 25, wherein said method includes the step of securing a sealing strip to said drainage member to cover said plurality of slots and prevent water from flowing therethrough.

27. A method of forming a drainage member as defined in claim 20, wherein said step of deforming said base portion to form expansion zones includes reducing the thickness of said base portion along a width that is generally transverse to said longitudinal extent of said base portion.

* * * * *